US009240092B2

(12) United States Patent
Zorick

(10) Patent No.: US 9,240,092 B2
(45) Date of Patent: Jan. 19, 2016

(54) HOCKEY EQUIPMENT VENDING MACHINES

(71) Applicant: Broderick Zorick, Beaverton, OR (US)

(72) Inventor: Broderick Zorick, Beaverton, OR (US)

( * ) Notice: Subject to any disclaimer, the term of this patent is extended or adjusted under 35 U.S.C. 154(b) by 0 days.

(21) Appl. No.: 14/271,629

(22) Filed: May 7, 2014

(65) Prior Publication Data

US 2014/0332551 A1 Nov. 13, 2014

Related U.S. Application Data

(60) Provisional application No. 61/820,500, filed on May 7, 2013.

(51) Int. Cl.
*G07F 11/54* (2006.01)

(52) U.S. Cl.
CPC ..... *G07F 11/54* (2013.01); *A63B 59/70* (2015.10); *A63B 2102/24* (2015.10)

(58) Field of Classification Search
CPC ..... G07F 11/54
USPC ..... 221/119, 120, 121
See application file for complete search history.

(56) References Cited

U.S. PATENT DOCUMENTS

| | | | | |
|---|---|---|---|---|
| 3,129,039 | A * | 4/1964 | Staley | 312/97.1 |
| 3,979,017 | A * | 9/1976 | O'Toole et al. | 221/7 |
| 4,049,154 | A * | 9/1977 | Burks | 221/76 |
| 5,007,518 | A * | 4/1991 | Crooks et al. | 194/212 |
| 6,123,223 | A * | 9/2000 | Watkins | 221/121 |
| 2010/0017023 | A1* | 1/2010 | Jacomet et al. | 700/236 |
| 2013/0253700 | A1* | 9/2013 | Carson et al. | 700/236 |

* cited by examiner

*Primary Examiner* — Patrick Mackey
(74) *Attorney, Agent, or Firm* — Mohr Intellectual Property Law Solutions, PC

(57) ABSTRACT

Vending machines designed specifically for the sale and provision of large and potentially unusually shaped items, such as sporting goods, including an electronic system for the selection and sale of the vended items. In some examples, the vending machine includes multiple product storage areas designed for holding and vending varied goods such as hockey sticks, hockey stick blades, and related accessories, with each area separate and made accessible by the electronic system as appropriate based upon the purchased products selected by a user.

17 Claims, 5 Drawing Sheets

HOCKEY EQUIPMENT VENDING MACHINES

CROSS-REFERENCE TO RELATED APPLICATIONS

This application claims priority to U.S. Provisional Application Ser. No. 61/820,500, filed on May 7, 2013, which is hereby incorporated by reference for all purposes.

BACKGROUND

The present disclosure relates generally to vending machines that automatically dispense hockey equipment. In particular, vending machines that dispense hockey sticks and replacement blades for attachment to sticks are described.

Known hockey vending solutions are not entirely satisfactory for the range of applications in which they are employed. Because hockey is a fast paced contact sport, hockey players regularly need to replace their equipment during play. In particular, players often need to replace sticks or stick blades when they become damaged during play. As a result, there exists a need for hockey players to have quick, consistent access to replacement equipment when playing.

Playing locations often operate hockey pro shops that provide players with replacement equipment. Staffing and operating hockey pro shops, however, is both expensive and burdensome. In particular, it is often difficult to staff hockey pro shops during the early morning or late at night. As a result, it is difficult to provide consistent access to replacement equipment at all of the times in which players are commonly playing. Thus, there exists a need for automated hockey equipment vendors that provide consistent access to equipment without needing to operate a hockey pro shop.

Some existing vending machines are currently used to dispense hockey supplies. Often, however, repurposed vending machines originally designed to vend drinks and/or snacks are used to sell small hockey accessories. While such machines are suitable for selling select small hockey supplies, such as mouth guards, they are ill-suited for selling larger unwieldy items, such as replacement sticks and blades. As a result, maintaining a pro shop is the only practical means by which hockey playing locations are able to vend one piece hockey sticks and stick blades. Thus, there exists a need for an automated means by which hockey playing locations can vend hockey sticks and stick blades.

Further, the storage in repurposed vending machines is not designed specifically for dispensing hockey equipment. As a result, repurposed vending machines are limited in the selection of items they are able to store and provide to customers.

Thus, there exists a need for vending machines that improve upon and advance the design of known hockey equipment vending solutions. Examples of new and useful hockey equipment vending machines relevant to the needs existing in the field are discussed below.

SUMMARY

The present disclosure is directed to vending machines designed specifically for the sale and provision of large and potentially unusually shaped items, such as sporting goods, along with an electronic system for the selection and sale of the vended items. In some examples, the vending machine includes multiple product storage areas designed for holding and vending hockey sticks, hockey stick blades, and related accessories, with each area separate and made accessible by the electronic system as appropriate based upon the purchased products selected by a user.

DETAILED DESCRIPTION

The disclosed vending machines will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of vending machine examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
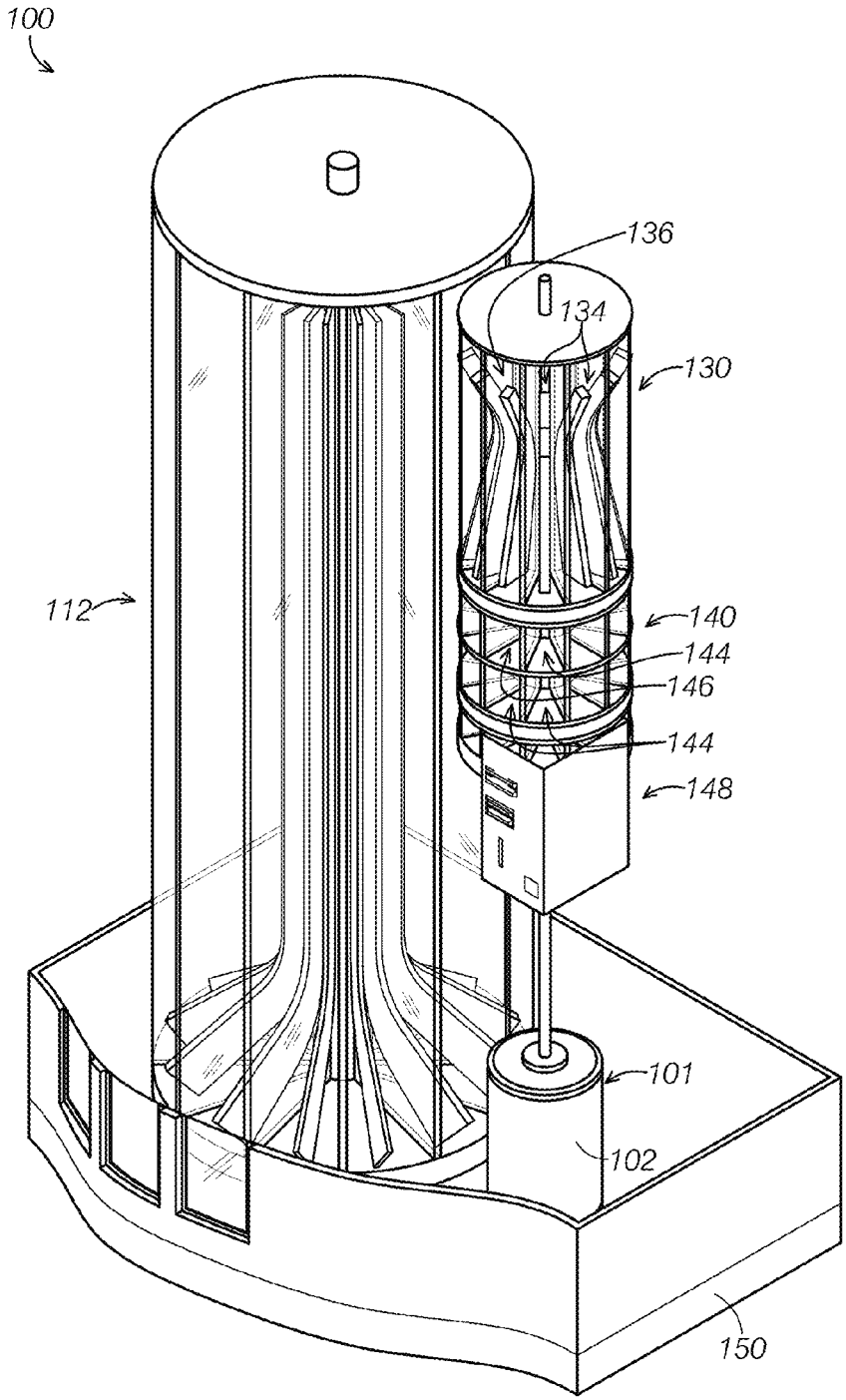
FIG. 1 is a cutaway perspective view of an example of a vending machine according to the present disclosure with a portion of the case removed to show interior features of the vending machine.

With reference to FIGS. 1-4, a first example of a vending machine designed to automatically vend hockey equipment, vending machine 100, will now be discussed. As FIG. 1 shows, vending machine 100 includes a stick dispenser 112, a stick blade dispenser 130, an accessory dispenser 140, an automated checkout system 148, a case 150, and a mechanical system 101.

Vending machine 100 provides an automated system for vending hockey equipment. As FIG. 1 shows, vending machine 100 includes several features specifically designed to store and vend hockey equipment, distinguishing it from many vending machines that have been repurposed for selling hockey equipment. In particular, vending machine 100 is able to vend larger items that do not fit in repurposed vending machines, such as replacement sticks and stick blades.

Because vending machine 100 is automated, vending machine 100 allows hockey recreation facilities to sell replacement equipment without operating a hockey pro shop. Further, the automated features of vending machine 100 provides hockey equipment sales during early mornings, late nights, and other times that may be impractical to operate a hockey pro shop with human personnel.

Figure 3:
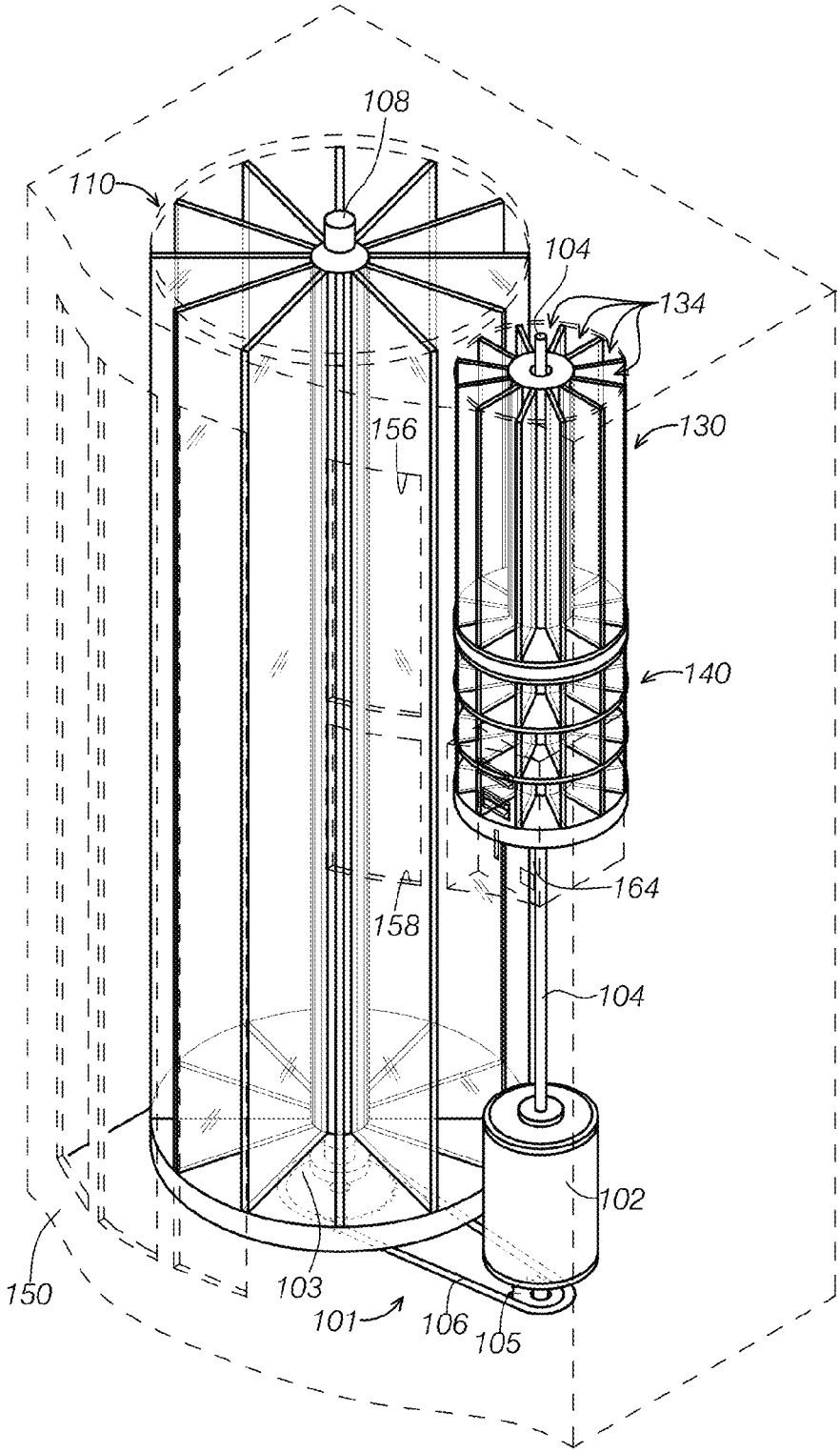
FIG. 3 is a perspective schematic view of the vending machine shown in FIG. 1 depicting the case and interior features of the vending machine.
Figure 4:
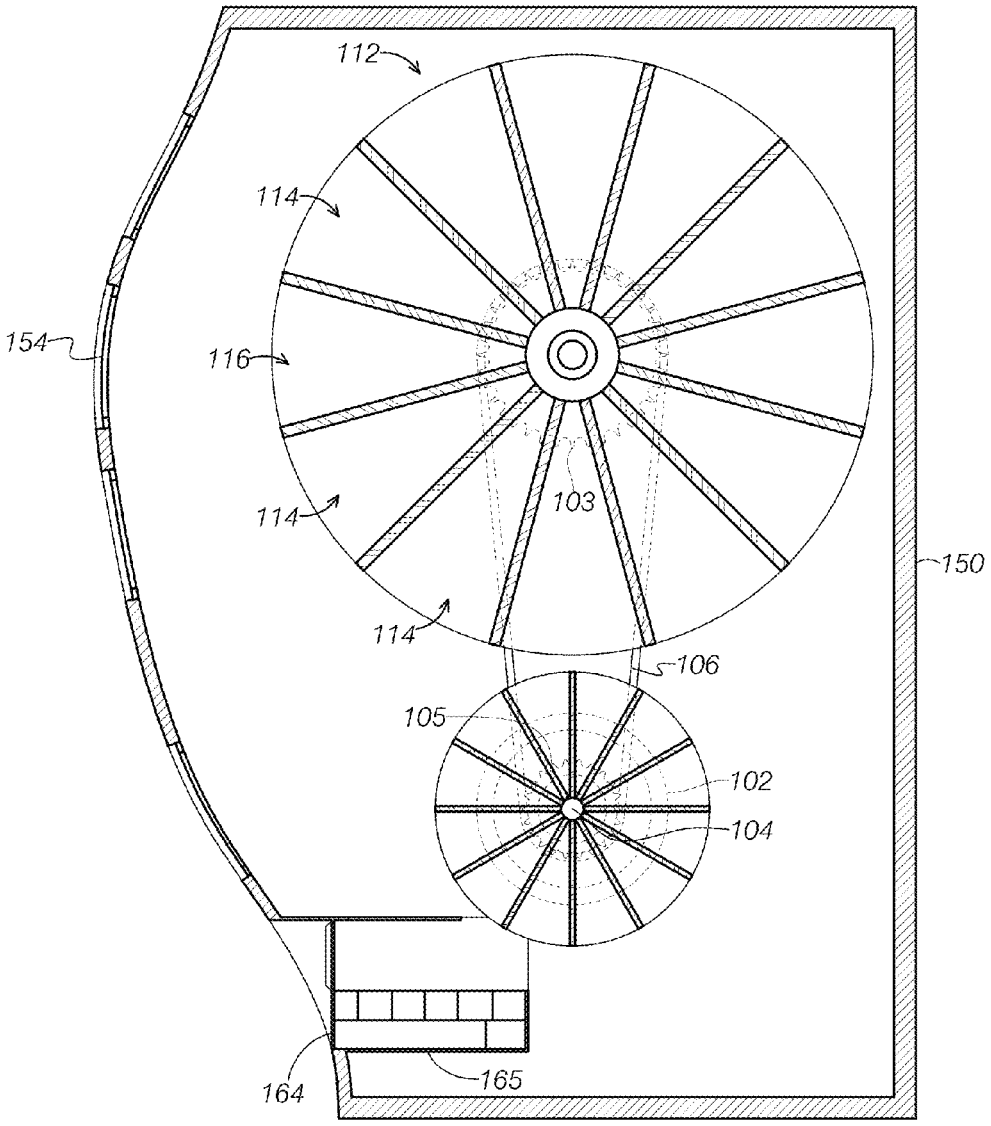
FIG. 4 is an overhead schematic view of the vending machine shown in FIG. 1 depicting the mechanical interface of the vending machine.
Figure 5:
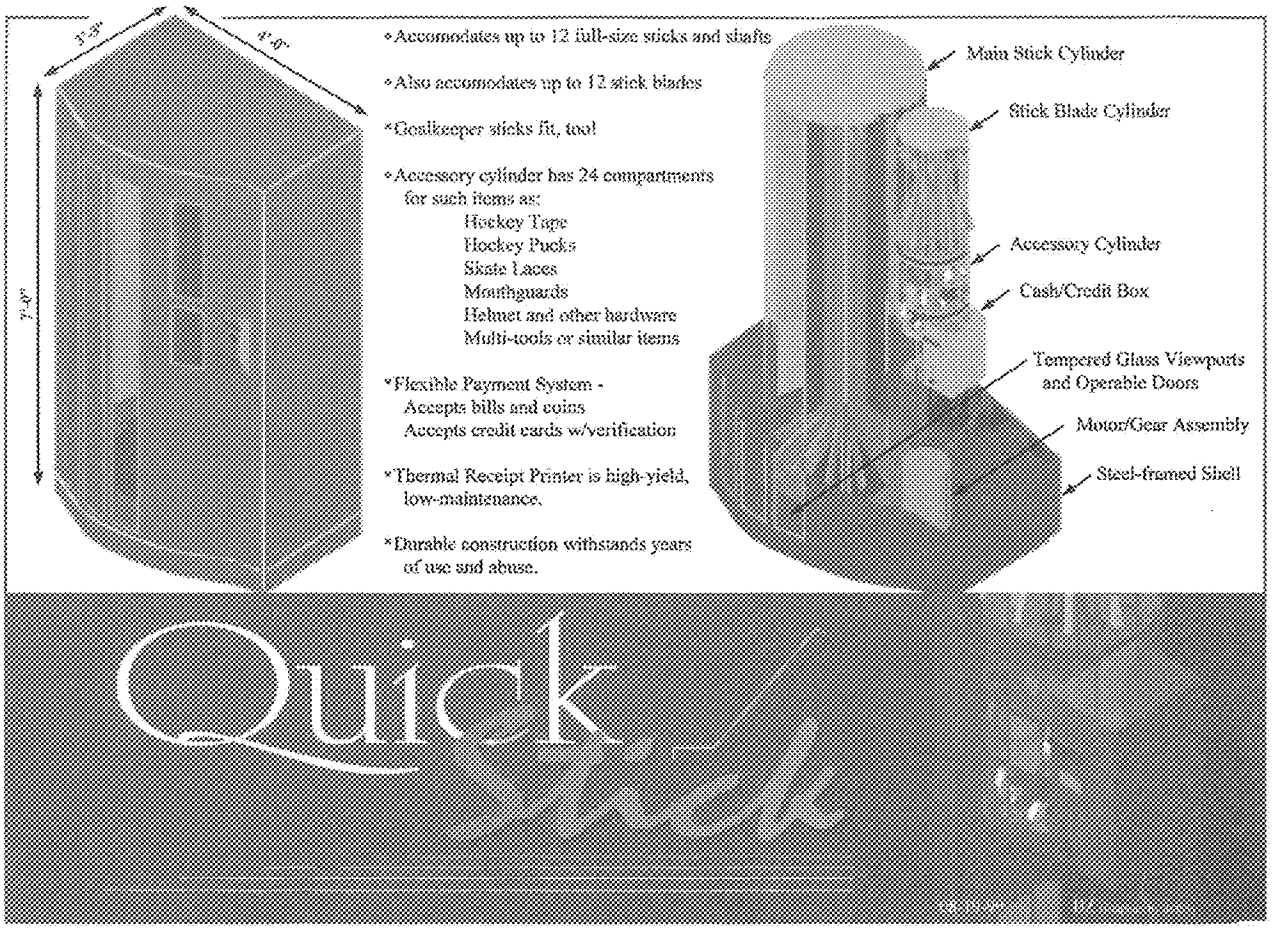
FIG. 5 illustrates promotional materials associated with a vending machine including features associated with the present disclosure.

As FIGS. 3 and 4 show, mechanical system 101 is operatively connected to stick dispenser 112, stick blade dispenser 130, and accessory dispenser 140. Mechanical system 101 includes a motor 102, a first shaft 104, a first gear 105, a chain 106, a second gear 103, and a second shaft 108. Mechanical system 101 is configured to rotationally drive stick dispenser 112, stick blade dispenser 130, and accessory dispenser 140 to display items available for sale. Further, mechanical system 101 is in electrical communication with automated checkout system 148, allowing potential purchasers to control mechanical system 101 and manipulate the dispensers to display specific items.

As FIG. 3 shows, motor 102 defines a standard motor drivingly connected to first shaft 104. Motor 102 is configured to rotationally drive first shaft 104, and first shaft 104 is configured to transfer the energy produced by motor 102 to the other elements of mechanical system 101. In some examples, vending machine 100 is connected to a nearby electrical outlet to provide electric power to motor 102, but other power sources are equally contemplated.

As FIGS. 3 and 4 show, first shaft 104 extends through motor 102. As FIGS. 3 and 4 also illustrate, first shaft 104 is fixedly connected to first gear 105 at a position below motor 102. Similarly, first shaft 104 is fixedly connected to accessory dispenser 140 and to stick blade dispenser 130 above motor 102.

As motor 102 drives first shaft 104, first shaft 104 directs rotational force produced by motor 102 to rotate accessory dispenser 140 and stick blade dispenser 130. As motor 102 adjusts the orientation of accessory dispenser 140 and stick dispenser 112, a potential purchaser is able to view the items in the dispensers that are available for purchase. Further, motor 102 drives first gear 105 through first shaft 104, allowing motor 102 to drive second shaft 108 and stick dispenser 112.

As FIG. 4 shows, chain 106 is connected between first gear 105 and second gear 103. Motor 102 rotationally drives first gear 105 through first shaft 104. Chain 106 transfers the rotational force that motor 102 applies to first gear 105 to second shaft 108. As a result, motor 102 is able to drive second shaft 108.

As FIG. 4 illustrates, second shaft 108 is fixedly connected to the center of second gear 103, allowing second gear 103 to drive second shaft 108 and stick dispenser 112. As FIG. 3 shows, second shaft 108 is routed through and fixedly connected to stick dispenser 112 substantially at the center of stick dispenser 112. Because second shaft 108 is operatively connected to second gear 103 and to stick dispenser 112, motor 102 is configured to rotationally drive stick dispenser 112.

As FIG. 1 shows, stick dispenser 112 is fixedly connected to second shaft 108 above second gear 103. Stick dispenser 112 is configured to store and dispense full replacement sticks with blades attached.

As FIG. 1 illustrates, stick dispenser 112 is substantially cylindrical. As FIGS. 3 and 4 show, stick dispenser 112 is divided into a plurality of stick storage compartments 114. Each stick storage compartment 114 defines a radial segment of stick dispenser 112. Further, each stick storage compartment 114 is sized to fit a single replacement stick. Replacement sticks stored in stick storage compartments 114 may be either standard size hockey sticks or goalkeeper sticks. Each radial segment may include a vertically inclined bottom surface configured to roughly conform to the shape of the stored sticks' blades when the stored sticks are in a substantially upright position.

As FIG. 4 shows, one stick storage compartment may be positioned in a dispensing position 116 at any given time. A selected compartment may be positioned in dispensing position 116, for example, in response to the user selecting the associated stick with automated checkout system 148. In response, mechanical system 101 may rotationally drive stick dispenser 112 to dispensing position 116.

As FIG. 4 shows, dispensing position 116 is substantially aligned with a selectively opening door of case 150. When the associated door is opened, a purchaser may retrieve a purchased replacement stick from the stick storage compartment positioned in dispensing position 116.

Stick dispenser 112 includes 12 stick storage compartments. Accordingly, stick dispenser 112 is configured to accommodate 12 full-size sticks and shafts. Some examples, however, include other quantities of storage compartments.

As FIG. 3 shows, stick blade dispenser 130 is fixedly connected to first shaft 104 above motor 102. Because stick blade dispenser 130 is fixedly connected to first shaft 104, motor 102 is configured to selectively rotate stick blade dispenser 130 to display the items contained in stick blade dispenser 130.

As FIGS. 1 and 3 illustrate, stick blade dispenser 130 is substantially cylindrical in shape. Similar to the stick storage compartments of stick dispenser 112, stick blade dispenser 130 includes a plurality of blade storage compartments 134. Each blade storage compartment 134 defines a radial segment of stick blade dispenser 130 sized to fit a single replacement stick blade. Like stick dispenser 112, mechanical system 101 may rotate stick blade dispenser 130 to display a selected blade storage compartment 134 in a blade dispensing position 136.

Stick blade dispenser 130 includes 12 blade storage compartments 134, thereby accommodating 12 stick blades at one time. However, some examples include other quantities of blade storage compartments.

As FIG. 3 illustrates, accessory dispenser 140 is fixedly connected to first shaft 104 between stick blade dispenser 130 and motor 102. Because accessory dispenser 140 is connected to first shaft 104, motor 102 is configured to selectively rotate accessory dispenser 140. When rotated, accessory dispenser 140 is configured to rotate to display the accessories stored in each accessory storage compartment 144.

As FIG. 3 illustrates, accessory dispenser 140 is substantially cylindrical in shape. As FIG. 1 shows, accessory dispenser 140 includes a plurality of accessory storage compartments 144. Each accessory storage compartment 144 is sized to store a single item. As FIG. 1 shows, accessory storage compartments 144 are arranged circumferentially around accessory storage compartments 144, similar to blade storage compartments 134 and stick storage compartments 114.

Accessory dispenser 140 includes multiple vertical rows of accessory storage compartments 144. In particular, accessory dispenser 140 includes two rows of 12 compartments, providing a total of 24 compartments. Other examples may include additional or fewer compartments or rows to accommodate different numbers of items.

Each accessory storage compartment 144 is configured to store a single accessory, such as a package of hockey tape, a hockey puck, a package or skate laces, a mouth guard, helmet hardware, multi-tools, or other small items that are often desired to be replaced or purchased when playing hockey.

Like stick dispenser 112 and stick blade dispenser 130, mechanical system 101 is configured to rotate accessory dispenser 140 to position a selected accessory in an accessory dispensing position 146.

In some examples, accessory dispenser 140 may include one or more adjustable compartment barriers configured to selectively bar access to unpurchased accessories. When a purchased item is in accessory dispensing position 146, for example, an unpurchased item may be aligned with the associated door and thus inadvertently accessible to the purchaser. Adjustable compartment barriers may restrict or prevent purchasers from improperly retrieving the unpurchased item when retrieving a purchased product from accessory dispensing position 146.

As FIG. 1 shows, case 150 is configured to enclose the internal components of vending machine 100, such as mechanical system 101, stick dispenser 112, stick blade dispenser 130, accessory dispenser 140, and automated checkout system 148.

Case 150 is constructed primarily of steel. The steel construction provides durability and structural support. Indeed, as FIGS. 1 and 3 show, case 150 is configured to serve as the primary support of several of the internal components of vending machine 100.

As FIG. 3 shows, first shaft 104 is rotatably connected to case 150 at both the top and the bottom of case 150. As FIG. 3 shows, case 150 supports first shaft 104 in a substantially vertical orientation while allowing first shaft 104 to rotate around its central longitudinal axis. As previously discussed, mechanical system 101 is able to rotatably drive first shaft 104 to rotate stick blade dispenser 130 and accessory dispenser 140.

As FIG. 3 illustrates, second shaft 108 is rotatably connected to case 150, substantially similar to first shaft 104. Like first shaft 104, second shaft 108 is rotatably supported by case 150 and is substantially vertically oriented. Mechanical system 101 is configured to rotationally drive second shaft 108 to display items stored in stick dispenser 112.

Figure 2:
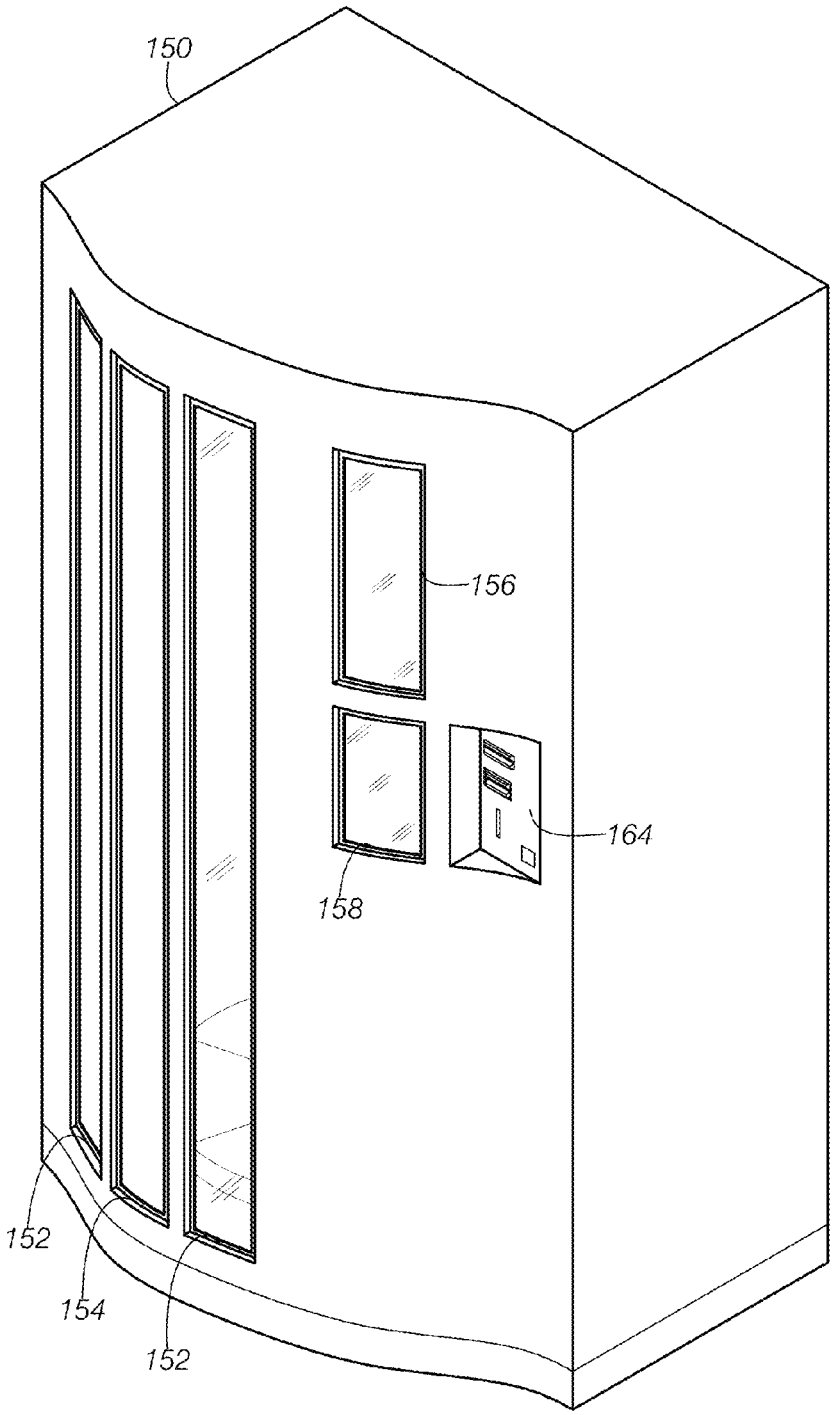
FIG. 2 is a perspective view of the case of the vending machine shown in FIG. 1.

As FIG. 2 shows, case 150 includes display windows 152, a stick dispensing door 154, a blade dispensing door 156, and an accessory dispensing door 158. Each of display windows 152, stick dispensing door 154, blade dispensing door 156, and accessory dispensing door 158 are made of a substantially translucent tempered glass. The translucent glass allows users to view products contained within the interior of case 150.

In some examples, dispensing doors are configured to be manually opened and closed upon purchase of an item. In such examples, automated checkout system 148 may instruct a purchaser to open the appropriate door upon purchasing an item.

In other examples, however, doors may automatically unlock or open upon purchase of an item. For example, stick dispensing door 154 is configured to automatically open upon a purchaser purchasing an item. Stick dispensing door 154 may, for example, open automatically upon receiving payment for a stick positioned at dispensing position 116.

As FIG. 4 shows, stick dispensing door 154 is substantially aligned with dispensing position 116. When stick dispensing door 154 is opened, the purchaser is able to reach through stick dispensing door 154 to retrieve a purchased stick from stick dispenser 112. In some examples, vending machines include barriers that bar access to stick storage compartments not in dispensing position 116.

As FIGS. 2 and 3 show, blade dispensing door 156 defines a selectively opening door substantially aligned with blade dispensing position 136. Similar to stick dispensing door 154, blade dispensing door 156 is configured to automatically open upon purchasing a selected stick blade. When blade dispensing door 156 is open, a purchaser is able to retrieve a purchased blade from blade dispensing position 136.

As FIGS. 2 and 3 show, accessory dispensing door 158 defines a selectively opening door substantially aligned with accessory dispensing position 146. Similar to stick dispensing door 154 and blade dispensing door 156, accessory dispensing door 158 is configured to automatically open upon purchase. When accessory dispensing door 158 is open, a purchaser may retrieve a purchased accessory from accessory dispensing position 146.

In some examples, cases include multiple accessory dispensing doors. Each accessory dispensing door is sized to provide access to a single accessory dispensing compartment and is aligned with one vertical row of accessory dispenser 140.

As FIG. 2 shows, case 150 includes a checkout system opening 164. checkout system opening 164 is sized to partially receive the front of automated checkout system 148. By partially receiving automated checkout system 148, case 150 supports automated checkout system 148 at a purchaser-accessible position. Automated checkout system 148 includes an item selection interface, a cash acceptor, a card acceptor, and a receipt printer. Automated checkout system 148 allows a purchaser to browse available items, select items for purchase, and provide payment to purchase the selected item.

As FIG. 4 shows, case 150 additionally includes a checkout system cavity 165 that receives automated checkout system 148. Checkout system cavity 165 extends longitudinally around the perimeter of automated checkout system 148 to house automated checkout system 148 in a substantially fixed position.

Automated checkout system 148 is in electrical communication with mechanical system 101. As a result, automated checkout system 148 is able to instruct mechanical system 101 to adjust the position of stored items for sale. Similarly, automated checkout system 148 is in electrical communication with stick dispensing door 154, blade dispensing door 156, and accessory dispensing door 158. As a result, automated checkout system 148 is able to instruct stick dispensing door 154, blade dispensing door 156, and accessory dispensing door 158 to selectively open and close to provide access to purchased items.

The item selection interface of automated checkout system 148 allows a potential purchaser to provide input for browsing items and selecting an item for purchase. Upon receiving input, automated checkout system 148 electrically instructs mechanical system 101 to adjust stick dispenser 112, stick blade dispenser 130, and/or accessory dispenser 140 to position the selected item in the dispensing position and display the selected item.

When an item has been selected for purchase, automated checkout system 148 requests payment. Payment may be received, for example, by receiving cash from the purchaser in the cash acceptor or by scanning a purchaser's credit or debit card in the card acceptor. Upon receiving payment, automated checkout system 148 instructs stick dispensing door 154, blade dispensing door 156, or accessory dispensing door 158 as appropriate to open to provide access to the purchased item. When open, the purchaser may retrieve the selected item through the appropriate dispensing door.

In some examples, dispensing doors may close automatically after providing the purchaser a reasonable amount of time to purchase a selected item.

Automated checkout system 148 includes a receipt printer configured to print out a receipt for purchased items. The receipt printer preferably is of a type of printer which makes efficient use of ink when printing and requires little maintenance.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

What is claimed is as follows:

1. A vending machine, comprising:

a plurality of product dispensers that are substantially cylindrical in shape;

a means for selecting one or more products from said product dispensers;

a means for positioning said product dispensers so as to enable access to the one or more selected products, wherein said positioning means comprises:

a motor attached to a first shaft, with said first shaft being attached to one of said product dispensers such that when said motor imparts rotation to said first shaft, said product dispenser is rotated; and said first shaft is attached to a means for imparting rotational motion to one or more additional shafts, with each of said additional shafts being attached to a product dispenser such that when said motor imparts rotation to said first shaft, said additional shafts and each of their attached product dispensers are rotated; and a means for accessing the one or more selected products.

2. The vending machine of claim 1, wherein each of said product dispensers is comprised of a plurality of compartments, each such compartment capable of holding one or more items.

3. The vending machine of claim 1, wherein one of said product dispensers is capable of holding a plurality of hockey sticks.

4. The vending machine of claim 1, further comprising a means to accept payment from a user for said one or more selected products.

5. The vending machine of claim 1, further comprising a housing, with said housing enclosing said product dispensers, said selecting means, said positioning means, and said accessing means.

6. The vending machine of claim 5, wherein said means for accessing the one or more selected products is comprised of a plurality of locking doors placed within said housing, with each of said locking doors corresponding to one of the said plurality of product dispensers, and positioned so as to allow access to a product stored in said dispenser.

7. The vending machine of claim 6, further comprising a means to accept payment from a user for said one or more selected products, and wherein said payment acceptance means controls said positioning means so as to position said product dispensers to allow said one or more selected products to be accessible by said accessing means; and each of said locking doors is locked or unlocked by said payment acceptance means depending upon which of said product dispensers said one or more selected products are located in.

8. The vending machine of claim 1, wherein said means for imparting rotational motion comprises:

a gear attached to said first shaft;

a gear attached to each of said one or more additional shafts; and a drive belt that engages each of said gears.

9. The vending machine of claim 8, wherein said drive belt is a chain.

10. The vending machine of claim 8, wherein said drive belt is a rubber belt.

11. A vending machine for hockey equipment, comprising:

an outer housing possessing a plurality of doors;

one or more stick dispensers capable of holding plurality of hockey sticks;

one or more stick blade dispensers capable of holding a plurality of hockey stick blades;

one or more accessory dispensers capable of holding a plurality of accessories of identical or varying types for use in the sport of hockey;

a means for a user to select a portion of the contents from said one or more stick dispensers, one or more stick blade dispensers, or one or more accessory dispensers; and a means for positioning said one or more stick dispensers, one or more stick blade dispensers, or one or more accessory dispensers such that the selected portion of contents from said dispenser are accessible through one of said plurality of doors, wherein said positioning means comprises:

a motor attached to a first shaft, with said first shaft being attached to one of said stick dispensers, stick blade dispensers, or accessory dispensers such that when said motor imparts rotation to said first shaft, said dispenser is rotated; and said first shaft is attached to a means for imparting rotational motion to one or more additional shafts, with each of said additional shafts being attached to a stick dispenser, stick blade dispenser, or accessory dispenser such that when said motor imparts rotation to said first shaft, said additional shafts and each of their attached dispensers are rotated; and wherein said stick dispensers, stick blade dispensers, and accessory dispensers are substantially cylindrical in shape.

12. The vending machine of claim 11, wherein said means for imparting rotational motion comprises:

a gear attached to said first shaft;

a gear attached to each of said one or more additional shafts; and a drive belt that engages each of said gears.

13. The vending machine of claim 12, wherein said drive belt is a chain.

14. The vending machine of claim 12, wherein said drive belt is a rubber belt.

15. The vending machine of claim 11, further comprising a means for accepting payment from a user for the contents selected from said dispensers.

16. The vending machine of claim 15, wherein said payment accepting means also provides said means for selecting a portion of the contents from said one or more stick dispensers, one or more stick blade dispensers, or one or more accessory dispensers.

17. The vending machine of claim 16, wherein said payment accepting means is in communication with said positioning means so as to facilitate the user accessing said selected portion of the contents through one of said plurality of doors.

* * * * *